US008469835B2

(12) United States Patent
Asakura et al.

(10) Patent No.: US 8,469,835 B2
(45) **Date of Patent: *Jun. 25, 2013**

(54) GOLF BALL

(75) Inventors: Takeshi Asakura, Kobe (JP); Kazuyoshi Shiga, Kobe (JP)

(73) Assignee: SRI Sports Limited, Kobe (JP)

( * ) Notice: Subject to any disclaimer, the term of this patent is extended or adjusted under 35 U.S.C. 154(b) by 331 days.

This patent is subject to a terminal disclaimer.

(21) Appl. No.: 11/705,409

(22) Filed: Feb. 13, 2007

(65) Prior Publication Data

US 2007/0191139 A1 Aug. 16, 2007

(30) Foreign Application Priority Data

Feb. 14, 2006 (JP) ..... 2006-037228

(51) Int. Cl.
*A63B 37/12* (2006.01)
*A63B 37/00* (2006.01)
*C08G 18/44* (2006.01)

(52) U.S. Cl.
USPC ..... 473/374; 473/371; 473/378; 528/85

(58) Field of Classification Search
USPC ..... 528/85, 370, 76; 473/351, 365, 374, 473/376, 378, 371; 564/475, 505
See application file for complete search history.

(56) References Cited

U.S. PATENT DOCUMENTS

| | | | | |
|---|---|---|---|---|
| 5,070,173 | A * | 12/1991 | Yokota et al. | 528/85 |
| 5,661,207 | A | 8/1997 | Carlson et al. | |
| 5,816,939 | A | 10/1998 | Hamada et al. | |
| 6,207,784 | B1 | 3/2001 | Rajagopalan | |
| 6,248,028 | B1 * | 6/2001 | Higuchi et al. | 473/374 |
| 6,267,694 | B1 * | 7/2001 | Higuchi et al. | 473/374 |
| 6,476,176 | B1 * | 11/2002 | Wu | 528/76 |
| 6,645,088 | B2 | 11/2003 | Wu et al. | |
| 6,846,898 | B2 | 1/2005 | Yokota | |
| 6,855,793 | B2 | 2/2005 | Harris et al. | |
| 6,958,380 | B2 | 10/2005 | Risen, Jr. et al. | |
| 7,915,373 | B2 * | 3/2011 | Shiga et al. | 528/85 |
| 2002/0173379 | A1 | 11/2002 | Wu et al. | |
| 2003/0153716 | A1 | 8/2003 | Wu et al. | |
| 2004/0082406 | A1 | 4/2004 | Wu et al. | |
| 2004/0254298 | A1 | 12/2004 | Kim et al. | |
| 2006/0178231 | A1 * | 8/2006 | Kasashima | 473/371 |
| 2007/0072701 | A1 * | 3/2007 | Nagasawa | 473/371 |
| 2007/0073031 | A1 | 3/2007 | Nagasawa et al. | |

FOREIGN PATENT DOCUMENTS

| | | | |
|---|---|---|---|
| JP | 5-29648 B2 | | 11/1990 |
| JP | 5-32756 | | 2/1993 |
| JP | 5-43647 | | 2/1993 |
| JP | 05-051428 | * | 3/1993 |
| JP | 5-51428 | | 3/1993 |
| JP | 9-262319 | | 10/1997 |
| JP | 2002-521157 | A | 7/2002 |
| JP | 2002-272878 | A | 9/2002 |
| JP | 2002-275234 | | 9/2002 |
| JP | 2002-275803 | | 9/2002 |
| JP | 2003-025366 | A | 1/2003 |
| JP | 2003-327652 | A | 11/2003 |
| JP | 2005-662 | | 1/2005 |
| JP | 2005-532436 | A | 10/2005 |
| WO | WO-2004/003047 | A1 | 1/2004 |

OTHER PUBLICATIONS

Japanese Application JP2006-353255, Notice of Reasons for Refusal, Dec. 16, 2008, pp. 1-3.
Japanese Application JP2006-353255, Notice of Reasons for Refusal, Jun. 2, 2009, pp. 1-2.
Japanese Office Action issued in Japanese patent application No. 2006-037228, dated Mar. 2, 2010.

* cited by examiner

*Primary Examiner* — Rabon Sergent
(74) *Attorney, Agent, or Firm* — Birch, Stewart, Kolasch & Birch, LLP

(57) ABSTRACT

An object of the present invention is to improve the abrasion-resistance of a golf ball having a polyurethane cover. Another object of the present invention is to enhance the resilience and the shot feeling thereof.

The present invention provides a golf ball having a cover, said cover comprising, as a base resin, a thermoplastic polyurethane containing a polycarbonate polyol as a constitutional component, wherein the polycarbonate polyol has, as a repeating constitutional unit, a repeating unit (A) shown in a following Formula (I), and
a repeating unit (B) shown in a following Formula (II) and having a different structure from that of (A),
and a molar ratio of (A)/(B) is from 30/70 to 70/30.

(I)

In Formula (I), $R^1$ is a bivalent residue obtained by removing two hydroxyl groups from a diol having 4 to 6 carbon atoms.

(II)

In Formula (II), $R^2$ is a bivalent residue obtained by removing two hydroxyl groups from a diol having 4 to 6 carbon atoms.

8 Claims, 1 Drawing Sheet

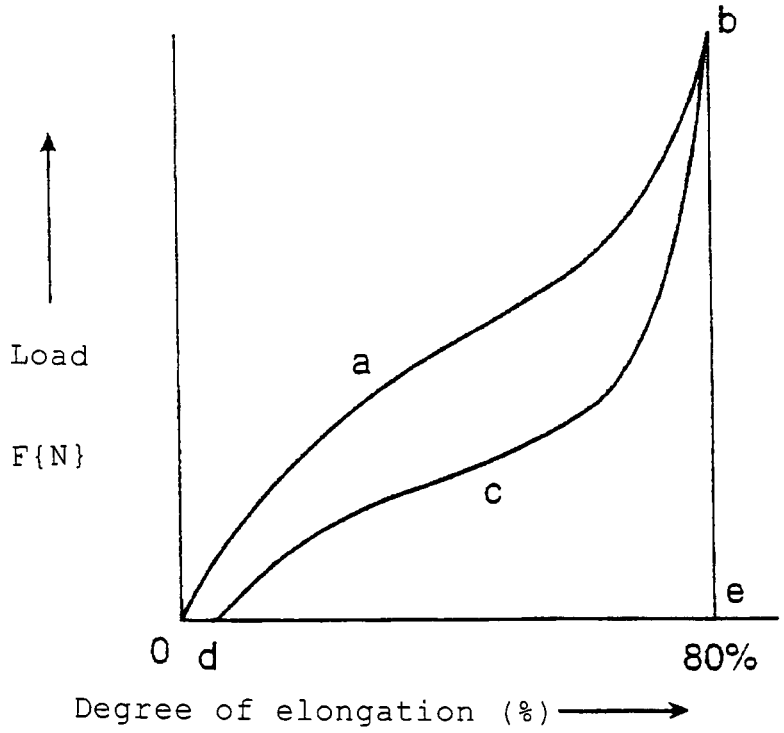
Af: Hysteresis loss ratio(%)
Af= Area (oabcd) / Area (oabeo) × 100

GOLF BALL

BACKGROUND OF THE INVENTION

1. Field of the Invention

The present invention relates to a golf ball having a polyurethane cover, more particularly to a golf ball having a polycarbonate polyol-based thermoplastic polyurethane cover.

2. Description of the Related Art

As a base resin constituting a cover of a golf ball, an ionomer resin or a polyurethane is used. Covers containing ionomer resins are widely used for their excellent resilience, durability, workability and the like. However, because of their high rigidity and hardness, problems such as bad shot feeling, inadequate spin performance and poor controllability are pointed out. On the other hand, the polyurethane is used as a base resin constituting the cover since it provides an improved shot feeling and spin properties compared with an ionomer resin.

However, the abrasion-resistance of the cover containing the polyurethane is not at a satisfactory level, and its resilience is not necessarily adequate, either.

In order to solve the problem, as the base resin of the cover, the thermoplastic polyurethane containing the polycarbonate polyol as the constitutional component has been disclosed. Japanese patent publication No. 2,002-272,878 A discloses a golf ball having a core and a polyurethane cover covering the core wherein the polyurethane cover comprises a cured body obtained by curing a polyurethane prepolymer having a terminal isocyanate group with a curing agent. The polyol component constituting the urethane prepolymer is a polycarbonate having a number average molecular weight of 300 to 3000. U.S. Pat. No. 6,855,793 discloses a golf ball using polycarbonate-urethane as a constitutional element using poly(1,6-hexyl-1,2-ethylcarbonate) as a polycarbonate intermediate.

SUMMARY OF THE INVENTION

A use of the polycarbonate using 1,6-hexanediol disclosed in Japanese patent publication No. 2,002-272,878 A enhances the resilience, but the abrasion-resistance of the polyurethane cover using 1,6-hexanediol was unsatisfactory because of its high crystallinity. In addition, the polycarbonate urethane disclosed in U.S. Pat. No. 6,855,793 cannot provide desired properties without a modification by a surfactant oligomer.

The present invention has been achieved in view of the above circumstances. An object of the present invention is to improve the abrasion-resistance of a golf ball having the polyurethane cover. Another object of the present invention is to enhance the resilience and the shot feeling of the golf ball.

The present invention is directed to a golf ball having a cover, and the cover comprises, as a base resin, a thermoplastic polyurethane containing a polycarbonate polyol as a constitutional component, wherein the polycarbonate polyol has, as a repeating constitutional unit, a repeating unit (A) shown in the following Formula (I), and a repeating unit (B) shown in the following Formula (II) and having a different structure from that of (A), and a molar ratio of (A)/(B) is from 30/70 to 70/30.

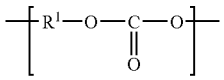

(I)

In Formula (I), $R^1$ is a bivalent residue obtained by removing two hydroxyl groups from a diol having 4 to 6 carbon atoms.

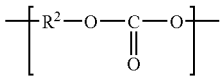

(II)

In Formula (II), $R^2$ is a bivalent residue obtained by removing 2 hydroxyl groups from a diol having 4 to 6 carbon atoms.

Namely, in the present invention, a polycarbonate polyol having two different repeating units is used as the polycarbonate polyol constituting the thermoplastic polyurethane, thus the crystallinity does not become too high, and the abrasion-resistance of the obtained urethane cover is improved. In addition, due to having a repeating unit with 4 to 6 carbon atoms, the crystallinity does not become too low. Accordingly, the thermoplastic polyurethane has good mechanical properties and the obtained urethane cover does not have the lower resilience.

Preferable examples of the polycarbonate polyol include the polycarbonate polyol where $R^1$ is a bivalent residue obtained by removing two hydroxyl groups from 1,4-butanediol, 1,5-pentanediol, or 1,6-hexanediol. In a more preferable embodiment, $R^1$ is a bivalent residue obtained by removing two hydroxyl groups from 1,4-butanediol and $R^2$ is a bivalent residue obtained by removing two hydroxyl groups from 1,6-hexanediol. Alternatively, $R^1$ is preferably a bivalent residue obtained by removing two hydroxyl groups from 1,5-pentanediol, and $R^2$ is a bivalent residue obtained by removing two hydroxyl groups from 1,6-hexanediol.

Furthermore, the thermoplastic polyurethane preferably has the hysteresis loss of 35% or less with respect to the energy applied at the elongation of 80%, when the elongation at break is 100%.

The present invention provides a golf ball having a urethane cover which is excellent in abrasion-resistance. The present invention further provides a golf ball which is excellent in resilience and shot feeling.

BRIEF DESCRIPTION OF THE DRAWINGS

FIG. 1 is an explanation drawing of the hysteresis loss.

DESCRIPTION OF THE PREFERRED EMBODIMENT

The present invention provides a golf ball having a cover, and the cover comprises, as a base resin, a thermoplastic polyurethane containing a polycarbonate polyol as a constitutional component. As a repeating constitutional unit, the polycarbonate polyol has a repeating unit (A) shown in a following Formula (I), and a repeating unit (B) shown in a following Formula (II) and having a different structure from that of (A), and a molar ratio of (A)/(B) is from 30/70 to 70/30.

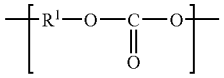

(I)

In Formula (I), $R^1$ is a bivalent residue of a diol having 4 to 6 carbon atoms from which two hydroxyl groups have been removed.

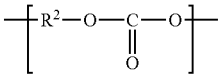

(II)

In Formula (II), $R^2$ is a bivalent residue obtained by removing two hydroxyl groups from a diol having 4 to 6 carbon atoms.

First, the thermoplastic polyurethane containing the polycarbonate polyol as the constitutional component used in the present invention will be explained. The thermoplastic polyurethane is not limited as long as it has the polycarbonate polyol as the constitutional component, a plurality of urethane bonds within a molecule, and a thermoplastic property. For example, the thermoplastic polyurethane includes a reaction product obtained by the reaction between the polyisocyanate and the polycarbonate polyol to form urethane bonds in a molecule. Further, a chain extension reaction with a low-molecular weight polyol or a polyamine can be conducted, where necessary. Herein, "polycarbonate polyol", which is well known to those skilled in the art, is a compound having a plurality of terminal hydroxyl groups, where the low-molecular weight diol components and the like are bonded via a carbonate bond.

The polycarbonate polyol (preferably polycarbonate diol) used in the present invention has, as the repeating constitutional unit, the repeating unit (A) shown in the following Formula (I) and the repeating unit (B) shown in the following Formula (II) which has a different structure from that of (A), wherein the molar ratio of (A)/(B) is from 30/70 to 70/30, more preferably the molar ratio of (A)/(B) is from 40/60 to 60/40, even more preferably the molar ratio of (A)/(B) is 50/50. If the molar ratio of either of (A) and (B) is too high, the crystallinity of the polycarbonate polyol becomes too high, and thus the abrasion-resistance of the resulting urethane cover is lowered.

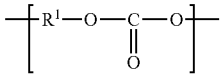

(I)

In Formula (I), $R^1$ is a bivalent residue obtained by removing two hydroxyl groups from a diol having 4 to 6 carbon atoms.

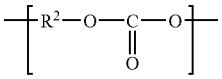

(II)

In Formula (II), $R^2$ is a bivalent residue obtained by removing two hydroxyl groups from a diol having 4 to 6 carbon atoms.

Herein, $R^1$ of the repeating unit (A) and $R^2$ of the repeating unit (B) are not limited as long as $R^1$ and $R^2$ are different each other and bivalent residues where two hydroxyl groups have been removed from a diol having 4 to 6 carbon atoms.

The crystallinity of the polycarbonate polyol is suppressed by employing different structures as the structures of $R^1$ and $R^2$.

Examples of the diol having 4 to 6 carbon atoms include a diol having 4 carbon atoms such as 1,2-butanediol, 1,3-butanediol, 1,4-butanediol, 1-methyl-1,3-propanediol, 2-methyl-1,3-propane diol; a diol having 5 carbon atoms such as 1,2-pentanediol, 1,3-pentanediol, 1,4-pentanediol, 1,5-pentanediol, 1,2-cyclopentanediol, 1,3-cyclopentanediol, 1,1-dimethyl-1,3-propanediol, 2,2-dimethyl-1,3-propanediol, 1,3-dimethyl-1,3-propanediol, 1-ethyl-1,3-propanediol, 2-ethyl-1,3-propanediol, 1-methyl-1,4-butanediol, 2-methyl-1,4-butanediol; a diol having 6 carbon atoms such as 1,2-hexanediol, 1,3-hexanediol, 1,4-hexanediol, 1,5-hexanediol, 1,6-hexanediol, 1,4-cyclohexane diol, methyl pentanediol, dimethyl butanediol, ethyl butanediol, trimethyl propanediol, and methylethyl propanediol.

Examples of the polycarbonate polyol include the polycarbonate polyol wherein $R^1$ is a bivalent residue in which two hydroxyl groups have been removed from 1,4-butanediol, 1,5-pentanediol or 1,6-hexanediol. Preferable examples are the polycarbonate polyol where $R^1$ is the bivalent residue obtained by removing two hydroxyl groups from 1,4-butanediol and $R^2$ is the bivalent residue obtained by removing two hydroxyl groups from 1,6-hexanediol, and the polycarbonate polyol where $R^1$ is the bivalent residue obtained by removing two hydroxyl groups from 1,5-pentanediol and $R^2$ is the bivalent residue obtained by removing two hydroxyl groups from 1,6-hexanediol.

In addition to the repeating unit (A) shown in Formula (I) above and the repeating unit (B) shown in Formula (II) above, the polycarbonate polyol used in the present invention may further contain a third repeating constitutional unit as the repeating constitutional unit, as long as the effects of the present invention are not undermined. However, it is most preferable that the polycarbonate polyol essentially consists of the repeating units (A) and (B) as the repeating constitutional unit.

The polycarbonate polyol which constitutes the thermoplastic polyurethane used in the present invention preferably has a weight average molecular weight of 1,000 or more, more preferably 1,500 or more, even more preferably 2,000 or more, and preferably has a weight average molecular weight of 4,000 or less, more preferably 3,500 or less, even more preferably 3,000 or less.

As the polyol component constituting the thermoplastic polyurethane used in the present invention, a general-purpose polyol may be used as long as the effects of the present invention are not undermined. Examples of the general-purpose polyol are a polyether polyol such as polyoxyethylene glycol (PEG), polyoxypropylene glycol (PPG), and polyoxytetramethylene glycol (PTMG); a condensed polyester polyol such as polyethylene adipate (PEA), polybutylene adipate (PBA), and polyhexamethylene adipate (PHMA); a lactone polyester polyol such as poly-ε-caprolactone (PCL); a polycarbonate polyol such as polyhexamethylene carbonate; and an acrylic polyol. The above polyols may also be used as a mixture of at least two of them.

A weight average molecular weight of the general-purpose polyol is preferably within the range from 400 to 10,000.

The polyisocyanate component, which constitutes the thermoplastic polyurethane containing the polycarbonate polyol as the constitutional component, is not limited as long as it has at least two isocyanate groups. Examples of the polyisocyanate include an aromatic polyisocyanate such as 2,4-tolylene diisocyanate, 2,6-tolylene diisocyanate, a mixture of 2,4-tolylene diisocyanate and 2,6-tolylene diisocyanate (TDI), 4,4'-diphenylmethane diisocyanate (MDI), 1,5-naphthylene dilsocyanate (NDI), 3,3'-bitolylene-4,4'-diisocyanate (TODI), xylylene diisocyanate (XDI), tetramethylxylylene-diisocyanate (TMXDI), para-phenylene diisocyanate (PPDI); an alicyclic polyisocyanate or aliphatic polyisocyanate such as 4,4'-dicyclohexylmethane diisocyanate ($H_{12}$MDI), hydrogenated xylylenediisocyanate ($H_6$XDI), hexamethylene diisocyanate (HDI), isophorone diisocyanate (IPDI), and norbornene diisocyanate (NBDI). These may be used either alone or as a mixture of at least two of them.

In view of improving the abrasion-resistance, an aromatic polyisocyanate is preferably used as a polyisocyanate component of polyurethane. A use of the aromatic polyisocyanate improves the mechanical property of the obtained polyurethane and provides the cover with the excellent abrasion-resistance. In addition, in view of improving the weather resistance, as the polyisocyanate component of the polyurethane, a non-yellowing type polyisocyanate such as TMXDI, XDI, HDI, $H_6$XDI, IPDI and $H_{12}$MDI is preferably used. More preferably, 4,4'-dicyclohexylmethane diisocyanate ($H_{12}$MDI) is used. Since 4,4'-dicyclohexylmethane diisocyanate ($H_{12}$MDI) has a rigid structure, the mechanical property of the resulting polyurethane is improved, and thus the cover which is excellent in abrasion-resistance can be obtained.

Examples of the low-molecular weight polyol which may be used as the chain extender include a diol such as ethylene glycol, diethylene glycol, triethylene glycol, 1,3-butanediol, 1,4-butanediol, neopentyl glycol, and 1,6-hexanediol; and a triol such as glycerin, trimethylol propane, and hexanetriol.

Furthermore, a low-molecular weight polyamine to be used as the chain extender is not limited as long as it has at least two amino groups. Examples of the polyamine include an aliphatic polyamine such as ethylenediamine, propylenediamine, butylenediamine, and hexamethylenediamine, an alicyclic polyamine such as isophoronediamine and piperazine, and an aromatic polyamine.

The aromatic polyamine has no limitation as long as it has at least two amino groups directly or indirectly bonded to an aromatic ring. Herein, the "indirectly bonded to the aromatic ring", for example, means that the amino group is bonded to the aromatic ring via a lower alkylene bond. Further, the aromatic polyamine includes, for example, a monocyclic aromatic polyamine having at least two amino groups bonded to one aromatic ring or a polycyclic aromatic polyamine having at least two aminophenyl groups each having at least one amino group bonded to one aromatic ring.

Examples of the monocyclic aromatic polyamine include a type such as phenylenediamine, tolylenediamine, diethyltoluenediamine, and dimethylthiotoluenediamine wherein amino groups are directly bonded to an aromatic ring; and a type such as xylylenediamine wherein amino groups are bonded to an aromatic ring via a lower alkylene group. Further, the polycyclic aromatic polyamine may include a poly (aminobenzene) having two aminophenyl groups directly bonded to each other or a compound having at least two aminophenyl groups bonded via a lower alkylene group or an alkylene oxide group. Among them, a diaminodiphenylalkane having two aminophenyl groups bonded to each other via a lower alkylene group is preferable. Typically preferred are 4,4'-diaminodiphenylmethane and the derivatives thereof.

The thermoplastic polyurethane containing the polycarbonate polyol as the constitutional component used in the present invention has no limitation on the constitutional embodiments thereof. Examples of the constitutional embodiments are the embodiment where the polyurethane is composed of the polyisocyanate component and the polycarbonate polyol component; the embodiment where the polyurethane is composed of the polyisocyanate component, the polycarbonate polyol component and the low-molecular weight polyol component; the embodiment where the polyurethane is composed of the polyisocyanate component, the polycarbonate polyol component, the low-molecular weight polyol component and the polyamine component; and the embodiment where the polyurethane is composed of the polyisocyanate component, the polycarbonate polyol component and the polyamine component.

The thermoplastic polyurethane used in the present invention preferably has the hysteresis loss of 35% or less with respect to the energy applied at the elongation of 80%, when the elongation at break is 100%. The hysteresis loss is more preferably from 5% to 30%, even more preferably from 10% to 25%. The hysteresis loss of the thermoplastic polyurethane is correlated with the crystallinity of the polycarbonate to be used; if the thermoplastic polyurethane has the hysteresis loss of more than 35%, the crystallinity of the polycarbonate to be used becomes too high, and thus the abrasion-resistance of the urethane cover may be lowered.

The cover of the golf ball of the present invention is not limited as long as it has, as the base resin, the thermoplastic polyurethane containing the above described polycarbonate polyol as the constitutional component. For example, the thermoplastic polyurethane is preferably contained in an amount of 50 parts or more, more preferably 60 parts or more, even more preferably 70 parts or more in 100 parts of the base resin by mass. Further, it is also preferably that the base resin essentially consists of the thermoplastic polyurethane.

The resin component, which may be used in combination with the thermoplastic polyurethane, include a thermoplastic polyamide elastomer having a commercial name of "PEBAX" such as "PEBAX 2533" available from ARKEMA Inc., a thermoplastic polyester elastomer having a commercial name of "HYTREL" such as "HYTREL 3548" and "HYTREL 4047" available from DU PONT-TORAY Co., a thermoplastic polyurethane elastomer having a commercial name of "ELASTOLLAN" such as "ELASTOLLAN XNY97A" available from BASF Polyurethane Elastomers, a thermoplastic polystyrene elastomer having a commercial name of "Rabalon" available from Mitsubishi Chemical Co, as well as the conventional ionomer resin.

In the present invention, the cover may contain, in addition to the above mentioned thermoplastic polyurethane, a pigment component such as zinc oxide, titanium oxide, and a blue pigment, a gravity adjusting agent such as calcium carbonate and barium sulfate, a dispersant, an antioxidant, an ultraviolet absorber, a light stabilizer, a fluorescent material or fluorescent brightener and the like as long as the cover performance is not undermined.

The content of the white pigment (titanium oxide) is preferably 0.5 part by mass or more, more preferably 1 part by mass or more, and preferably 10 parts by mass or less, more preferably 8 parts by mass or less based on 100 parts by mass of the base resin constituting the cover. The white pigment in an amount of 0.5 part by mass or more can impart opacity to the cover, while the white pigment in an amount of more than 10 parts by mass may lower the durability of the resulting cover.

In the present invention, the golf ball preferably has the urethane cover with a thickness of 1.0 mm or less, more preferably 0.6 mm or less, even more preferably 0.5 mm or less. If the thickness is 1.0 mm or less, the outer diameter of the core can be increased, thus the resilience is enhanced. The lower limit of the thickness of the urethane cover is, for example, but not limited to, 0.3 mm. If the thickness is less than 0.3 mm, the molding of the urethane cover may become difficult.

The urethane cover preferably has the slab hardness of 20 or more, more preferably 25 or more, and preferably has the slab hardness of 50 or less, more preferably 45 or less in shore D hardness. If the cover hardness is less than 20, the flying distance may be lowered due to the lowered resilience of the resultant golf ball. On the other hand, if the cover hardness is more than 50, the durability of the obtained golf ball may be lowered. The slab hardness of the cover can be measured by forming the cover composition into sheets having a thickness of about 2 mm by hot press molding, keeping the sheets for two weeks at the temperature of 23 C.°, and stacking three or more of the sheets on one another to avoid being affected by the measuring substrate on which the sheets were placed for measurement using the Shore D type spring hardness tester prescribed by ASTM-D2240.

The present invention is preferably applied to a golf ball having a cover, and may be applied to any of the following: a two-piece golf ball having a core and a cover covering the core; a three-piece golf ball having a core, an intermediate layer covering the core and a cover covering the intermediate layer; a multi-piece golf ball consisting of at least four layers; and a wound golf ball having a wound core and a cover. In a three-piece golf ball or a multi-piece golf ball, when the intermediate layer is regarded as a part of the core, it may be referred to as the multi-layer core, while when the intermediate layer is regarded as a part of the cover, it may be referred to as a multi-layer cover.

In the following, the method for preparing the golf ball of the present invention will be explained based on the embodiment of the two-piece golf ball, but the present invention is not limited to the two-piece golf ball and the process explained below.

As the core of the two-piece golf ball, a conventionally well-known core may be used. The core is obtained, for example, by heat-pressing the rubber composition for the core containing a base rubber, a crosslinking initiator, a crosslinking agent, a filler, and an antioxidant. As the base rubber, a natural rubber and/or a synthetic rubber such as a polybutadiene rubber, a natural rubber, a polyisoprene rubber, a styrene polybutadiene rubber, and ethylene-propylene-diene terpolymer (EPDM) may be used. Among them, typically preferred is the high cis-polybutadiene having cis-1,4 bond in a proportion of 40% or more, more preferably 70% or more, even more preferably 90% or more in view of its superior repulsion property.

As the crosslinking initiator, an organic peroxide is preferably used. Examples of the organic peroxide include an organic peroxide such as dicumyl peroxide, 1,1-bis (t-butylperoxy)-3,5-trimethylcyclohexane, 2,5-dimethyl-2,5-di(t-butylperoxy) hexane, and di-t-butyl peroxide. Among them, dicumyl peroxide is preferably used. The amount of the organic peroxide to be blended is preferably 0.3 part by mass or more, more preferably 0.4 part by mass or more, and preferably 5 parts by mass or less, more preferably 3 parts by mass or less with respect to 100 part by mass of the base rubber. If the content is less than 0.3 part by mass, the core becomes too soft, and the resilience tends to be lowered, and if the content is more than 5 parts by mass, the core becomes too hard and the shot feeling may be lowered.

As the crosslinking agent, an α,β-unsaturated carboxylic acid having 3 to 8 carbon atoms or the metal salt thereof may be used. As the metal forming the metal salt, zinc, magnesium, calcium, aluminum, and sodium may be used, and zinc is preferably used because it can provide an enhanced resilience. As the α,β-unsaturated carboxylic acid or the metal salt thereof, for example, acrylic acid, methacrylic acid, zinc acrylate, and zinc methacrylate are preferably used.

The amount of the co-crosslinking agent to be blended in the rubber composition is preferably 10 parts by mass or more, more preferably 15 parts by mass or more, even more preferably 20 parts by mass or more, and preferably 55 parts by mass or less, more preferably 50 parts by mass or less, even more preferably 48 parts by mass or less based on 100 parts by mass of the base rubber. If the amount of crosslinking agent to be used is less than 10 parts by mass, the amount of organic peroxide to be used needs to be increased so as to obtain an appropriate hardness, thus the resilience tends to be lowered. On the other hand, if the amount of the crosslinking agent used is more than 55 parts by mass, the core would become too hard and the shot feeling may be lowered.

As the filler, a filler conventionally formulated in the core of the golf ball may be used. The filler includes, for example, an inorganic salt such as zinc oxide, barium sulfate and calcium carbonate, a high gravity metal powder such as a tungsten powder and a molybdenum powder and the mixture thereof. The content of the filler is preferably 0.5 part by mass or more, more preferably 1 part by mass or more, and is preferably 30 parts by mass or less, more preferably 20 parts by mass or less. If the content is less than 0.5 part by mass, it would be difficult to adjust the gravity, while if the content is more than 30 parts by mass, the ratio of the rubber contained in the whole core becomes low and thus the resilience is lowered.

The rubber composition for the core may further contain an organic sulfur compound, an antioxidant or a peptizing agent, in addition to the base rubber, the crosslinking agent, the organic peroxide and the filler.

As the organic sulfur compound, diphenyl disulfide or a derivative thereof may be preferably used. The amount of diphenyl disulfide or the derivative thereof to be blended is preferably 0.1 part by mass or more, more preferably 0.3 part by mass or more, and preferably 5.0 parts by mass or less, more preferably 3.0 parts by mass or less based on 100 parts by mass of the base rubber. Examples of the diphenyl disulfide or the derivative thereof include diphenyl disulfide, a mono-substituted diphenyl disulfide such as bis(4-chlorophenyl)disulfide, bis(3-chlorophenyl)disulfide, bis(4-bromophenyl)disulfide, bis(3-bromophenyl)disulfide, bis(4-fluorophenyl)disulfide, bis(4-iodophenyl)disulfide, and bis(4-cyanophenyl)disulfide; a di-substituted diphenyl disulfide such as bis(2,5-dichlorophenyl)disulfide, bis(3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide, and bis(2-cyano-5-bromophenyl)disulfide; a tri-substituted diphenyl disulfide such as bis(2,4,6-trichlorophenyl)disulfide, and bis (2-cyano-4-chloro-6-bromophenyl)disulfide; a tetra substituted diphenyl disulfide such as bis(2,3,5,6-tetrachlorophenyl)disulfide; a penta substituted diphenyl disulfide such as bis(2,3,4,5,6-pentachlorophenyl)disulfide and bis(2,3,4,5,6-pentabromophenyl)disulfide. These diphenyl disulfide and the derivative thereof have some influence on the state of vulcanization of the vulcanized rubber body, and enhance the resilience thereof. Among them, in view of obtaining the golf ball having high resilience, diphenyl disulfide, and bis(penta bromophenyl)disulfide are particularly preferred. The amount of the antioxidant to be blended is preferably 0.1 part by mass or more and 1 part by mass or less based on 100 parts by mass of the base rubber. Further, the peptizing agent is preferably 0.1 part by mass or more and 5 parts by mass or less based on 100 parts by mass of the base rubber.

The core may be obtained by mixing and kneading the above rubber composition for the core, and molding it in the mold. The conditions for molding are not limited. The molding is preferably carried out for 10 to 40 minutes at a temperature of 130 to 180 C.° under a pressure of 2.9 to 11.8 MPa.

In the present invention, for example, the core is covered with a cover composition containing the thermoplastic polyurethane described above to form a golf ball. The method of covering the cover is not limited, and a conventional method of forming a cover may be employed. Examples of the method are the method which comprises molding the cover composition into hemispherical half shells beforehand, covering the core using two half shells, and subjecting the core with two half shells to the pressure molding for 1 to 5 minutes at a temperature of 130 to 170 C.°, and the method which comprises injection-molding the cover composition directly onto the core to form a cover. Further, when forming the cover to obtain a golf ball body, the cover can be formed with a multiplicity of concavities, which are so called "dimple", at the surface thereof. As required, the surface of the golf ball can be subjected to grinding treatment such as sandblast in order to enhance the adhesion of the mark and the paint film.

The golf ball of the present invention can be applied to a wound golf ball. In that case, for example, a wound core comprising a center formed by curing the above rubber composition for the core and a rubber thread layer which is formed by winding a rubber thread around the center in an elongated state can be used. In the present invention, the rubber thread, which is conventionally used for winding around the center, can be adopted for winding around the center. The rubber thread, for example, is obtained by vulcanizing a rubber composition including a natural rubber, or a mixture of natural rubber and a synthetic polyisoprene, a sulfur, a vulcanization auxiliary agent, a vulcanization accelerator, and an antioxidant. The rubber thread is wound around the center in elongation of about 10 times length to form the wound core.

When preparing a three-piece golf ball or a multi-piece golf ball, as the intermediate layer, for example, a thermoplastic polyamide elastomer having a commercial name of "PEBAX", for example, "PEBAX 2533", available from ARKEMA Inc; a thermoplastic polyester elastomer having a commercial name of "HYTREL", for example, "HYTREL 3548" and "HYTREL 4047" available from DU PONT-TORAY Co.; a thermoplastic polystyrene elastomer having a commercial name of "ELASTOLLAN", for example, "ELASTOLLAN XNY97A" available from BASF Japan; and a thermoplastic polyurethane elastomer having a commercial name of Rabalon" available from Mitsubishi Chemical Co. may be used in addition to the cured product of the rubber composition and the conventional ionomer resins. Examples of the ionomer resin include an ionomer resin prepared by neutralizing at least a part of carboxyl groups in a copolymer composed of ethylene and α,β-unsaturated carboxylic acid with a metal ion, one prepared by neutralizing at least a part of carboxyl groups in a ternary copolymer composed of ethylene, α,β-unsaturated carboxylic acid having 3 to 8 carbon atoms and α,β-unsaturated carboxylic acid ester with a metal ion, or a mixture thereof.

Specific examples of the ionomer resins include, but not limited to, Himilan 1555 (Na), Himilan 1557 (Zn), Himilan 1605 (Na), Himilan 1706 (Zn), Himilan 1707 (Na), Himilan AM7311 (Mg), and examples of the ternary copolymer ionomer resin include Himilan 1856 (Na) and Himilan 1855 (Zn) available from MITSUI-DUPONT POLYCHEMICAL CO., LTD.

Further, ionomer resins available from DUPONT CO. include Surlyn 8945 (Na), Surlyn 9945 (Zn), Surlyn 8140 (Na), Surlyn 8150 (Na), Surlyn 9120 (Zn), Surlyn 9150 (Zn), Surlyn 6910 (Mg), Surlyn 6120 (Mg), Surlyn 7930 (Li), Surlyn 7940 (Li), Surlyn and AD8546 (Li), and examples of the ternary copolymer ionomer resin include Surlyn 8120 (Na), Surlyn 8320 (Na), Surlyn 9320 (Zn), and Surlyn 6320 (Mg).

Ionomer resins such as Iotek 8000 (Na), Iotek 8030 (Na), Iotek 7010 (Zn), and Iotek 7030 (Zn) are available from Exxon Co. Examples of the ternary copolymer ionomer resin include Iotek 7510 (Zn) and Iotek 7520 (Zn).

Na, Zn, K, Li, or Mg described in the parentheses after the commercial name of the ionomer resin represents a kind of metal used for neutralization. The intermediate layer may further contain a gravity adjusting agent such as barium sulfate and tungsten, an antioxidant, a pigment and the like.

Examples

The following examples illustrate the present invention, however these examples are intended to illustrate the invention and are not to be construed to limit the scope of the present invention. Many variations and modifications of such examples will exist without departing from the scope of the inventions. Such variations and modifications are intended to be within the scope of the invention.

[Evaluation Method]

(1) Abrasion-Resistance

A commercially available pitching wedge was installed on a swing robot available from Golf laboratory Co., and two points of a ball respectively were hit once at the head speed of 36 m/sec. The areas which were hit were observed, evaluated and ranked into five levels based on following criteria.

5 points: No scratch was present, or scratches were hardly conspicuous.

4 points: A few scratches could be observed, but were barely annoying.

3 points: A little scuffing was present on the surface.

2 points: Scuffing or a lack of dimples was observed on the surface.

1 point: Dimples had been completely scraped away.

(2) Method of Measuring Hysteresis Loss

A sample having a width of 5 mm and a thickness of 2 mm was prepared using a thermoplastic polyurethane to be subjected to a tensile test to measure the elongation at break using an autograph tensile test device manufactured by Shimadzu Corporation under the following conditions: distance between the chucks=80 mm; head speed=300 mm/min. Next, a new sample was subjected to the measurement under the same conditions for the hysteresis loss at the elongation of 80% with respect to elongation at break.

The hysteresis loss was calculated from the area ratio of the obtained chart as shown below.

$$\text{Hysteresis loss ratio (\%)}=100\times\text{Area}(oabcd)/\text{Area}(oabed)$$

Herein, FIG. 1 is a schematic diagram showing the chart obtained by measuring the hysteresis loss of the above sample, wherein the Area (oabcd) and the Area (oabeo) mean the areas of the Region (oabcd) and the Region (oabeo) shown in FIG. 1 respectively.

(3) Shot Feeling

Actual hitting test was carried out by ten golfers including two professional golfers and eight high-level amateur golfers (handicap of less than 5) with a metal head driver (W#1). The shot feeling in terms of resilience was evaluated based on the following criteria. Major result of the results provided by the ten golfers was regarded as the shot feeling of the golf ball.

Excellent (E): The shot feeling of the golf ball is good with resilience.

Fair (F): Normal

Poor (P): The shot feeling is bad, with a heavy feeling and weak resilience.

(4) Repulsion Coefficient of Golf Ball

An aluminum cylinder having a weight of 200 g was allowed to collide with each golf ball at the speed of 45 m/sec. to measure the speed of the cylinder and the golf ball before and after the collision. The repulsion coefficient of each golf ball was calculated from the respective speeds and the weights of the cylinder and the golf ball. The measurement was carried out five times for each golf ball, and the average was taken as the repulsion coefficient of the golf ball. Each value of the repulsion coefficient was reduced to an index number relative to the value of golf ball No. 3 being assumed 100. The larger index number indicates better resilience.

(5) Slab Hardness (Shore D Hardness/Shore A Hardness)

The cover compositions or the polyurethane were each formed into sheets each having a thickness of about 2 mm by hot press molding and the resulting sheets were maintained at 23 C.° for two weeks. Three or more of the sheets were stacked on one another to avoid being affected by the measuring substrate on which the sheets were placed, and the stack was subjected to the measurement using P1 type auto hardness tester provided with the Shore D type spring hardness tester/A Type prescribed by ASTM-D2240, available from KOUBUNSHI KEIKI CO., LTD.

[Preparation of Three-Piece Golf Ball]

(1) Preparation of Multi-Layer Core

The rubber composition for the core shown in Table 1 was kneaded, and was subjected to heat-pressing for 30 minutes in the upper and lower molds having a spherical cavity at the temperature of 140 C.° to obtain an internal layer core (center) in a spherical shape having a diameter of 38.5 mm and a weight of 34.9 g.

TABLE 1

| Core composition | Amount(parts) |
|---|---|
| Polybutadiene rubber | 100 |
| Zinc acrylate | 37 |
| Zinc oxide | Appropriate amount* |
| Bis (pentabromophenyl) disulfide | 0.7 |
| Dicumyl peroxide | 0.9 |

*The zinc oxide was suitably added so that the weight of the obtained golf ball becomes 45.4 g.

Notes on Table 1

Polybutadiene rubber: BR730 (high cis-polybutadiene) available from JSR Co.

Zinc acrylate: ZNDA-90S available from NIHON JYORYU KOGYO Co, .LTD.

Zinc oxide: "Ginrei R" produced by Toho-Zinc Co.

Dicumyl peroxide: Percumyl D available from NOF Corporation

The zinc oxide was suitably added so that the weight of the obtained golf ball becomes 45.4 g.

Next, as an ionomer resin, 50 parts by mass of "Himilan 1605" available from MITSUI-DUPONT POLYCHEMICAL and 50 parts by mass of "Surlyn 9945" available from DUPONT CO. were mixed in twin-screw kneading extruder to prepare the material for an outer layer core in the form of the pellet. The extrusion was carried out under the following conditions: screw diameter=45 mm, screw revolutions=200 rpm, screw L/D=35. The material for the outer layer core was heated at a temperature between 150 C.° and 230 C.° at the die position of the extruder. The multi layer core consisting of the inner layer core and the outer layer core (having a diameter of 41.7 mm) was prepared by directly inject-molding the obtained material for the outer layer core onto the inner layer core.

(2) Preparation of Cover Material

The cover composition shown in Table 2 was mixed in a twin-screw kneading extruder to prepare the cover composition into the form of the pellet. Extrusion was carried out in the following conditions: screw diameter of 45 mm, screw revolutions of 200 rpm, and screw L/D=35.

(3) Molding of Half Shell

The half shells were compression-molded by charging the cover material in the form of the pellet obtained as described above into each of the depressed parts of the lower molds, and applying pressure to mold half shells. The compression-molding was carried out at the temperature of 170 C.° for 5 minutes under the pressure of 100 kgf/cm$^2$.

(4) Molding of the Cover

The multi layer core obtained in (1) was covered with two half shells obtained in (3) and subjected to the compression-molding to form the cover. The molding was carried out at the temperature of 140 C.° for 5 minutes under the pressure of 100 kgf/cm$^2$. The surface of the obtained golf ball body was subjected to sandblast treatment and marking followed by coating a clear paint, drying at the temperature of 40 C.° in an oven to dry the paint to obtain a golf ball having a diameter of 42.7 mm and a weight of 45.4 g.

The obtained golf ball was evaluated in terms of abrasion-resistance, resilience, and shot feeling. The results are also shown in Table 2.

TABLE 2

| | Structure of polycarbonate polyol component | | | Golf ball No. | | | | |
|---|---|---|---|---|---|---|---|---|
| Cover composition | Diol component of repeating unit A | Diol component of repeating unit B | Molar ratio of A/B | 1 | 2 | 3 | 4 | 5 |
| Cover Material | — | — | — | — | — | — | — | |
| Thermoplastic polyurethane 1 | 1,4-BD | 1,6-HD | 50/50 | 100 | — | — | — | — |
| Thermoplastic polyurethane 2 | 1,5-PD | 1,6-HD | 50/50 | — | 100 | — | | — |
| Thermoplastic polyurethane 3 | 1,4-BD | 1,6-HD | 70/30 | — | — | 100 | — | — |
| Thermoplastic polyurethane 4 | 1,4-BD | 1,6-HD | 90/10 | — | — | — | 100 | — |
| Thermoplastic polyurethane 5 | 1,6-HD | — | Component A: 100 | — | — | — | — | 100 |
| Titanium oxide | — | — | — | 4 | 4 | 4 | 4 | 4 |
| | Properties | | | — | — | — | — | — |
| | Hysteresis loss (%) | | | 20 | 8 | 35 | 50 | 70 |
| | Abration-resistance | | | 5 | 5 | 4 | 2 | 1 |
| | Resilience | | | 101 | 103 | 100 | 97 | 95 |
| | Shot feeling | | | E | E | E | P | P |
| | Slab hardness (Shore D) | | | 30D/82A | 25D/76A | 28D/79A | 25D/76A | 28D/80A |

Formulation: parts

Polyisocyanate component: MDI 1,4-BD: 1,4-butanediol;

1,5-PD: 1,5-pentandiol;

1,6-HD: 1,6-hexanediol

Notes on Table 2

Thermoplastic polyurethane 1: PCDL T4652 available from Asahi Kasei Chemicals Corporation Thermoplastic polyurethane 2: PCDL T5652 available from Asahi Kasei Chemicals Corporation Thermoplastic polyurethane 3: PCDL T4672 available from Asahi Kasei Chemicals Corporation Thermoplastic polyurethane 4: PCDL T4692 available from Asahi Kasei Chemicals Corporation Thermoplastic polyurethane 5: PCDL T6002 available from Asahi Kasei Chemicals Corporation Golf balls No. 1 to No. 3 are three-piece golf balls having a core, an intermediate layer and a cover, said cover comprising as the base resin a thermoplastic polyurethane containing a polycarbonate polyol as the constitutional component, wherein the repeating unit (A) constituting the polycarbonate polyol and the repeating unit (B) having a different structure from that of (A) satisfied the condition where the molar ratio of (A)/(B) is within the range from 30/70 to 70/30. In either case, the golf ball proved to be excellent in the abrasion-resistance. Further, the golf balls No. 1 to No. 3 were also excellent in the shot feeling and the resilience. On the other hand, Golf ball No. 4 is the case where the polycarbonate polyol containing an excessive amount of (A), one of the two components, was used. Golf ball No. 5 is the case where the polycarbonate polyol consisting of (A), one of the two components, was used. In either case, hysteresis loss was more than 35%, and the abrasion-resistance was considerably lowered.

The present invention is of value in that it provides a golf ball having a urethane cover which is excellent in the abrasion-resistance, and, further, is excellent in the resilience and the shot feeling.

This application is based on Japanese Patent application No. 2006-37228 filed on Feb. 14, 2006, the contents of which are hereby incorporated by reference.

What is claimed is:

1. A golf ball having a core, an intermediate layer covering the core, and a cover covering the intermediate layer, wherein said intermediate layer comprises an ionomer resin and does not include a thermoplastic polyester elastomer, said cover comprises a thermoplastic polyurethane containing a polycarbonate polyol as a constitutional component, wherein the thermoplastic polyurethane is contained in an amount of 50 parts by mass or more in 100 parts by mass of a resin component of said cover, the polycarbonate polyol has, as a repeating constitutional unit, a repeating unit (A) shown in a following Formula (I), and a repeating unit (B) shown in a following Formula (II) and having a different structure from that of (A), and a molar ratio of (A)/(B) is from 30/70 to 70/30;

(I)

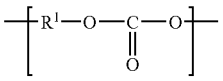

wherein $R^1$ is a bivalent residue obtained by removing two hydroxyl groups from a diol having 4 carbon atoms;

(II)

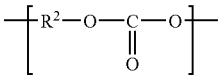

wherein $R^2$ is a bivalent residue obtained by removing two hydroxyl groups from a diol having 6 carbon atoms;

wherein the thermoplastic polyurethane has hysteresis loss of 35% or less with respect to the energy applied at the elongation of 80%, when the elongation at break is 100% and the polyurethane cover has a slab hardness of from 20 to less than 30 in Shore D hardness.

2. The golf ball according to claim 1, wherein the thermoplastic polyurethane has the hysteresis loss of from 5% to 30% with respect to the energy applied at the elongation of 80%, when the elongation at break is 100%.

3. The golf ball according to claim 1, wherein the thermoplastic polyurethane has the hysteresis loss of from 10% to 25% with respect to the energy applied at the elongation of 80%, when the elongation at break is 100%.

4. The golf ball according to claim 1, wherein the molar ratio of (A)/(B) is from 40/60 to 60/40.

5. The golf ball according to claim 1, wherein the thermoplastic polyurethane contains an aromatic polyisocyanate as a constitutional component.

6. A golf ball having a core, an intermediate layer covering the core and an urethane cover covering the intermediate layer, wherein said intermediate layer comprises an ionomer resin and does not include a thermoplastic polyester elastomer, said urethane cover comprises a thermoplastic polyurethane containing a polycarbonate polyol as a constitutional component, wherein the thermoplastic polyurethane is contained in an amount of 50 parts by mass or more in 100 parts by mass of a resin component of said cover, the polycarbonate polyol has, as a repeating constitutional unit, a repeating unit (A) shown in a following Formula (I), and a repeating unit (B) shown in a following Formula (II) and having a different structure from that of (A), and a molar ratio of (A)/(B) is from 40/60 to 60/40;

(I)

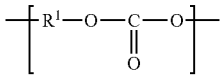

wherein $R^1$ is a bivalent residue obtained by removing two hydroxyl groups from 1,4-butanediol;

(II)

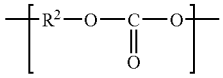

wherein $R^2$ is a bivalent residue obtained by removing two hydroxyl groups from 1,6-hexanediol;

wherein the thermoplastic polyurethane has hysteresis loss of 35% or less with respect to the energy applied at the elongation of 80%, when the elongation at break is 100% and the polyurethane cover has a slab hardness of from 20 to less than 30 in Shore D hardness.

7. The golf ball according to claim 6, wherein the golf ball is a three-piece golf ball.

8. The golf ball according to claim 6, wherein the thermoplastic polyurethane contains an aromatic polyisocyanate as a constitutional component.

* * * * *